US011808110B2

(12) United States Patent
Elston et al.

(10) Patent No.: US 11,808,110 B2
(45) Date of Patent: Nov. 7, 2023

(54) SYSTEM AND METHODOLOGY FOR ACTUATING A DOWNHOLE DEVICE

(71) Applicant: Schlumberger Technology Corporation, Sugar Land, TX (US)

(72) Inventors: Cassius Elston, Taubate (BR); Thomas Meeks, Houston, TX (US); Venkata Siva Reddy Battula, Houston, TX (US); Ashish Sharma, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 231 days.

(21) Appl. No.: 17/594,336

(22) PCT Filed: Apr. 21, 2020

(86) PCT No.: PCT/US2020/029097
§ 371 (c)(1),
(2) Date: Oct. 12, 2021

(87) PCT Pub. No.: WO2020/219435
PCT Pub. Date: Oct. 29, 2020

(65) Prior Publication Data

US 2022/0186585 A1 Jun. 16, 2022

Related U.S. Application Data

(60) Provisional application No. 62/837,786, filed on Apr. 24, 2019.

(51) Int. Cl.
*E21B 34/10* (2006.01)
*E21B 34/14* (2006.01)

(52) U.S. Cl.
CPC ..... *E21B 34/10* (2013.01); *E21B 34/14* (2013.01); *E21B 2200/04* (2020.05)

(58) Field of Classification Search
CPC ..... E21B 34/10; E21B 34/14; E21B 2200/04
(Continued)

(56) References Cited

U.S. PATENT DOCUMENTS 3,819,282 A 6/1974 Schultz
4,031,826 A 6/1977 Gemmell et al.
(Continued)

FOREIGN PATENT DOCUMENTS

CA 2887636 C 4/2014
CN 107060720 A 8/2017
(Continued)

OTHER PUBLICATIONS

International Search Report and Written Opinion issued in the PCT Application PCT/US2022/021548 dated Jun. 23, 2022 (10 pages).
(Continued)

*Primary Examiner* — Taras P Bemko
(74) *Attorney, Agent, or Firm* — Jeffrey D. Frantz

(57) ABSTRACT

A technique facilitates actuation of a downhole device, such as an isolation valve. According to an embodiment, the downhole device may be in the form of an isolation valve member, e.g. a ball valve element, actuated between positions by a mechanical section which may comprise a shifting linkage. Actuation of the mechanical section, and thus actuation of the isolation valve member, is achieved by a trip saver section controlled according to a pressure signature which may be applied from a suitable location, e.g. from the surface. The trip saver section comprises a housing having an internal actuation piston coupled with the mechanical section. The trip saver section further comprises a pilot piston and a plurality of chambers formed in a wall of the
(Continued)

housing and arranged to enable shifting of the actuation piston in response to a predetermined series of pressure pulses or other suitable pressure signature.

20 Claims, 3 Drawing Sheets

(58) Field of Classification Search
USPC ..... 166/373
See application file for complete search history.

(56) References Cited

U.S. PATENT DOCUMENTS

| | | | |
|---|---|---|---|
| 4,041,865 | A | 8/1977 | Evans et al. |
| 5,191,937 | A | 3/1993 | Cook, Sr. |
| 5,273,116 | A | 12/1993 | Ross |
| 5,392,856 | A | 2/1995 | Broussard, Jr. et al. |
| 5,435,390 | A | 7/1995 | Baugh et al. |
| 5,558,153 | A | 9/1996 | Holcombe et al. |
| 5,911,277 | A | 6/1999 | Hromas et al. |
| 6,021,095 | A | 2/2000 | Tubel et al. |
| 6,172,614 | B1 | 1/2001 | Robison et al. |
| 6,450,258 | B2 | 9/2002 | Green et al. |
| 6,450,263 | B1 | 9/2002 | Schwendemann |
| 6,925,807 | B2 | 8/2005 | Jones et al. |
| 6,945,331 | B2 | 9/2005 | Patel |
| 7,025,130 | B2 | 4/2006 | Bailey et al. |
| 7,108,073 | B2 | 9/2006 | Patel |
| 7,237,616 | B2 | 7/2007 | Patel |
| 7,336,474 | B2 | 2/2008 | Lerche et al. |
| 7,337,850 | B2 | 3/2008 | Contant |
| 7,347,272 | B2 | 3/2008 | Patel et al. |
| 7,367,405 | B2 | 5/2008 | Murray |
| 7,461,580 | B2 | 12/2008 | Bell et al. |
| 7,597,139 | B2 | 10/2009 | Moyes |
| 7,597,151 | B2 | 10/2009 | Curtis et al. |
| 7,604,062 | B2 | 10/2009 | Murray |
| 7,610,958 | B2 | 11/2009 | Moyes |
| 7,642,926 | B2 | 1/2010 | Liberale et al. |
| 7,673,680 | B2 | 3/2010 | Buyers et al. |
| 7,681,651 | B2 | 3/2010 | Loughlin |
| 7,681,652 | B2 | 3/2010 | Gaudette et al. |
| 7,748,462 | B2 | 7/2010 | Reid |
| 7,891,434 | B2 | 2/2011 | Gaudette et al. |
| 7,963,322 | B2 | 6/2011 | Richard et al. |
| 8,164,980 | B2 | 4/2012 | Sullivan et al. |
| 8,191,629 | B2 | 6/2012 | Gordon et al. |
| 8,469,106 | B2 | 6/2013 | Caminari et al. |
| 8,499,826 | B2 | 8/2013 | Hillis et al. |
| 8,517,113 | B2 | 8/2013 | Sheffield |
| 8,536,528 | B2 | 9/2013 | DiFoggio |
| 8,602,105 | B2 | 12/2013 | Sinclair |
| 8,616,276 | B2 | 12/2013 | Tips et al. |
| 8,684,093 | B2 | 4/2014 | Segura et al. |
| 8,689,887 | B2 | 4/2014 | Ross |
| 8,714,005 | B2 | 5/2014 | Vetter |
| 8,733,448 | B2 | 5/2014 | Skinner et al. |
| 8,776,890 | B2 | 7/2014 | Basmajian et al. |
| 8,851,160 | B2 | 10/2014 | Stolboushkin |
| 8,851,161 | B2 | 10/2014 | Scott et al. |
| 8,893,798 | B2 | 11/2014 | Hayter et al. |
| 8,943,884 | B2 | 2/2015 | Kumar |
| 8,991,496 | B2 | 3/2015 | Bishop |
| 9,022,108 | B2 | 5/2015 | Chatelet et al. |
| 9,103,197 | B2 | 8/2015 | Purkis |
| 9,121,250 | B2 | 9/2015 | Godfrey et al. |
| 9,145,980 | B2 | 9/2015 | Lauderdale |
| 9,163,488 | B2 | 10/2015 | Tips et al. |
| 9,273,549 | B2 | 3/2016 | Walton et al. |
| 9,309,745 | B2 | 4/2016 | Patel |
| 9,316,091 | B2 | 4/2016 | Symms |
| 9,353,600 | B2 | 5/2016 | Cong et al. |
| 9,404,340 | B2 | 8/2016 | Wood et al. |
| 9,428,999 | B2 | 8/2016 | Tips et al. |
| 9,598,933 | B2 | 3/2017 | Inglis |
| 9,631,445 | B2 | 4/2017 | Hradecky |
| 9,664,004 | B2 | 5/2017 | Martinez et al. |
| 9,664,007 | B2 | 5/2017 | Lopez et al. |
| 9,670,941 | B2 | 6/2017 | Dalton et al. |
| 9,745,823 | B2 | 8/2017 | Wood et al. |
| 9,777,557 | B2 | 10/2017 | Richard et al. |
| 9,845,661 | B2 | 12/2017 | Williamson et al. |
| 9,869,153 | B2 | 1/2018 | Moreno et al. |
| 9,903,192 | B2 | 2/2018 | Entchev et al. |
| 9,903,971 | B2 | 2/2018 | Swett |
| 9,926,769 | B2 | 3/2018 | Wood et al. |
| 9,958,838 | B2 | 5/2018 | Zacharko et al. |
| 10,066,467 | B2 | 9/2018 | Getzlaf et al. |
| 10,125,572 | B2 | 11/2018 | Wood et al. |
| 10,145,200 | B2 | 12/2018 | McKenzie |
| 10,174,586 | B2 | 1/2019 | Symms |
| 10,221,680 | B2 | 3/2019 | August et al. |
| 10,233,725 | B2 | 3/2019 | Provost |
| 10,253,594 | B2 | 4/2019 | Wakefield et al. |
| 10,287,851 | B2 | 5/2019 | El Mallawany |
| 10,301,908 | B2 | 5/2019 | Wakefield et al. |
| 10,309,174 | B2 | 6/2019 | Burgos et al. |
| 10,352,117 | B2 | 7/2019 | OConnor |
| 10,365,079 | B2 | 7/2019 | Harrington et al. |
| 10,408,025 | B2 | 9/2019 | Harrington et al. |
| 10,408,048 | B2 | 9/2019 | Roberson et al. |
| 10,480,283 | B2 | 11/2019 | Joseph et al. |
| 10,502,024 | B2 | 12/2019 | Wang et al. |
| 10,533,387 | B2 | 1/2020 | Dirksen et al. |
| 10,563,481 | B2 | 2/2020 | Richards |
| 10,584,560 | B2 | 3/2020 | Alley |
| 10,584,563 | B2 | 3/2020 | Richards et al. |
| 10,619,474 | B2 | 4/2020 | Ufondu et al. |
| 10,689,948 | B2 | 6/2020 | Hardesty et al. |
| 10,697,256 | B2 | 6/2020 | Wiedecke et al. |
| 10,781,677 | B2 | 9/2020 | Mlcak |
| 10,794,157 | B2 | 10/2020 | Kohn et al. |
| 2004/0020643 | A1 | 2/2004 | Thomeer et al. |
| 2007/0144731 | A1 | 6/2007 | Murray et al. |
| 2008/0066931 | A1 | 3/2008 | Xu |
| 2011/0056679 | A1 | 3/2011 | Rytlewski |
| 2011/0146984 | A1* | 6/2011 | Krush ..... E21B 43/04 166/278 |
| 2011/0168403 | A1 | 7/2011 | Patel |
| 2011/0265987 | A1 | 11/2011 | Wright et al. |
| 2012/0267119 | A1 | 10/2012 | Patel |
| 2012/0285702 | A1 | 11/2012 | Rytlewski |
| 2013/0306374 | A1 | 11/2013 | Wood |
| 2014/0246236 | A1* | 9/2014 | Radford ..... E21B 10/322 175/57 |
| 2017/0275984 | A1 | 9/2017 | Wang et al. |
| 2019/0055816 | A1 | 2/2019 | Johnson et al. |
| 2019/0376368 | A1 | 12/2019 | Miller et al. |
| 2020/0072045 | A1 | 3/2020 | Bramlage et al. |
| 2020/0115992 | A1 | 4/2020 | Wang et al. |

FOREIGN PATENT DOCUMENTS

| | | | |
|---|---|---|---|
| EP | 3012400 | B1 | 4/2020 |
| GB | 2280013 | B | 1/1995 |
| WO | WO2006000799 | A2 | 1/2006 |
| WO | 2007103680 | A1 | 9/2007 |
| WO | 2008060893 | A2 | 5/2008 |
| WO | 2009105128 | A1 | 8/2009 |
| WO | 2009154817 | A2 | 12/2009 |
| WO | 2011119448 | A2 | 9/2011 |
| WO | 2014210367 | A2 | 12/2014 |
| WO | 2017213885 | A1 | 12/2017 |
| WO | 2018118921 | A1 | 6/2018 |
| WO | 2018132666 | A1 | 7/2018 |
| WO | 2019132969 | A1 | 7/2019 |
| WO | 2019183316 | A1 | 9/2019 |
| WO | 2021167917 | A1 | 8/2021 |
| WO | 2021168032 | A1 | 8/2021 |
| WO | 2022010993 | A1 | 1/2022 |

(56) References Cited

FOREIGN PATENT DOCUMENTS

| | | | |
|---|---|---|---|
| WO | 2022204284 | A1 | 9/2022 |
| WO | 2022216535 | A1 | 10/2022 |

OTHER PUBLICATIONS

International Search Report and Written Opinion issued in the PCT Application PCT/US2022/022992 dated Jul. 8, 2022 (10 pages).
International Search Report and Written Opinion issued in the PCT Application PCT/US2020/029097 dated Jul. 27, 2021 (14 pages).
International Preliminary Report on Patentability issued in the PCT Application PCT/US2020/029097 dated Oct. 4, 2021 (11 pages).

* cited by examiner

SYSTEM AND METHODOLOGY FOR ACTUATING A DOWNHOLE DEVICE

CROSS-REFERENCE TO RELATED APPLICATION

The present document is based on and claims priority to U.S. Provisional Application Ser. No. 62/837,786, filed Apr. 24, 2019, which is incorporated herein by reference in its entirety.

BACKGROUND

In many well applications, a well string is deployed downhole with a formation isolation valve. The isolation valve may be placed in an open position to enable movement of equipment and/or fluid through the well string. However, the isolation valve may be placed in a closed position to seal off access to formations below the valve. For example, the isolation valve may be closed after retrieval of equipment used in performance of certain testing, perforating, or completion functions. The formation isolation valve may be useful in preventing fluid loss or in controlling an under balanced condition downhole. However, existing isolation valves tend to have substantial length and complexity.

SUMMARY

In general, a system and methodology are provided for facilitating actuation of a downhole device. According to an embodiment, the downhole device may be in the form of an isolation valve member, e.g. a ball valve element, actuated between positions by a mechanical section which may comprise a shifting linkage. Actuation of the mechanical section, and thus actuation of the isolation valve member, is achieved by a trip saver section controlled according to a pressure signature which may be applied from the surface or from another suitable location. The trip saver section comprises a housing having an internal actuation piston which may be coupled with the mechanical section. The trip saver section further comprises a pilot piston and a plurality of chambers formed in a wall of the housing. The pilot piston and chambers are arranged to enable shifting of the pilot piston and thus the actuation piston in response to a predetermined series of pressure pulses or other suitable pressure signature.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
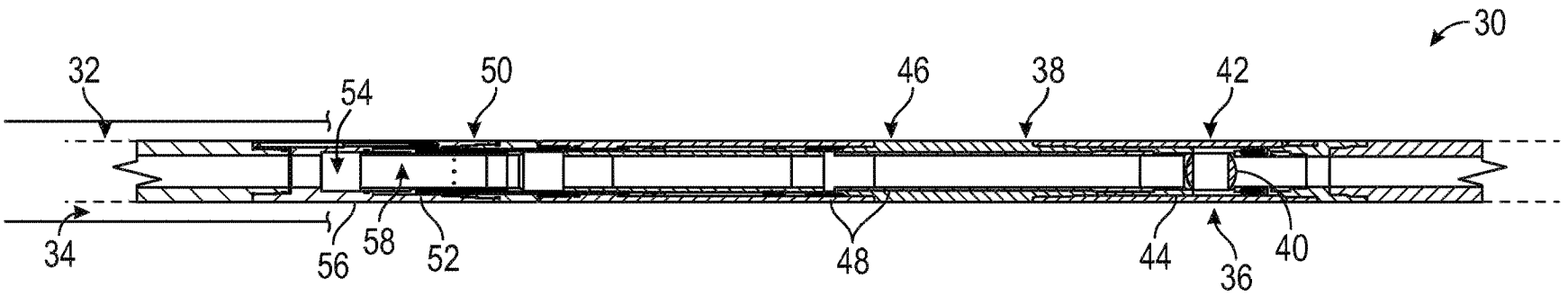
FIG. 1 is a cross-sectional illustration of an example of a well string deployed in a borehole and combined with an isolation valve, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate actuation of an isolation valve or other downhole device. According to an embodiment, an isolation valve comprises an isolation valve member, e.g. a ball valve element, which may be actuated between positions. For example, the isolation valve member may be actuated between closed and open positions by a mechanical section having a shifting linkage.

Actuation of the mechanical section, and thus actuation of the isolation valve member, is achieved by a trip saver section controlled according to a pressure signature. The pressure signature may be a pressure signal applied from the surface or from another suitable location. The trip saver section comprises a housing having an internal actuation piston coupled with the mechanical section. The trip saver section further comprises a pilot piston and a plurality of chambers and flow ports formed in a wall of the housing. The pilot piston, chambers, and flow ports are arranged to enable shifting of the pilot piston and thus the actuation piston in response to a predetermined series of pressure pulses or other suitable pressure signature. For example, the trip saver section may respond to the pressure signature so as to shift an isolation valve ball valve element from a closed position to an open position or vice versa.

The construction of the trip saver section reduces the length of the isolation valve compared to traditional isolation valves. Additionally, use of the pressure signature enables the elimination of control lines. The simpler construction also reduces the number of potential leak paths and creates a more robust and dependable isolation valve structure. Various embodiments also enable use of a reverse ball design in which the ball valve element is pulled to an open position rather than pushed, thus reducing forces on internal parts.

As described in greater detail below, the trip saver section provides an actuation mechanism able to generate high opening forces in a cost-effective manner. Additionally, embodiments of the trip saver section enable the generation of force to move actuation components based on tubing pressure versus atmospheric pressure. For example, an internal atmospheric pressure chamber may be created in the isolation valve and separated from the tubing fluid with a pilot piston. The pilot piston may be installed in a corresponding chamber within a housing of the trip saver section. When it is time to actuate the isolation valve, the pilot piston is moved to allow fluid to pour into the atmospheric chamber. As the fluid pours into the atmospheric chamber, a pressure differential is created across an actuation piston. The pressure differential establishes a force which moves appropriate linkages to shift an actuatable device, e.g. a ball valve element, from one operational position to another.

Referring generally to FIG. 1, an example of a well system 30 is illustrated. The well system 30 may comprise a well string 32, e.g. a well completion string, deployed in a wellbore 34 or other type of borehole. The well system 30 also may comprise an actuatable device 36 which may be selectively actuated between operational positions in response to a pressure signature. For example, a pressure signature, e.g. pressure pulses, may be supplied from the surface and down through well string 32 to initiate actuation of device 36.

In the embodiment illustrated, the actuatable device 36 may be part of an isolation valve 38 disposed along the well string 32. For example, the actuatable device 36 may be in the form of a ball valve element 40 or other type of actuatable valve element. According to the illustrated embodiment, the isolation valve 38 may comprise a ball section 42 which includes the ball valve element 40 rotatably mounted in a corresponding ball section housing 44.

The ball valve element 40 (or other actuatable device) may be shifted between operational positions via a mechanical section 46 which may comprise a mechanical linkage 48 connected to the ball valve element 40 or other actuatable device. The mechanical section 46 and mechanical linkage 48 are operatively coupled with a trip saver section 50 which is constructed to respond to the pressure signature, e.g. pressure pulse signal, to cause shifting of, for example, mechanical linkage 48 and ball valve element 40. By way of example, the trip saver section 50 may be used to shift the ball valve element 40 from a closed position to an open position via the pressure signature applied from the surface.

Figure 2:
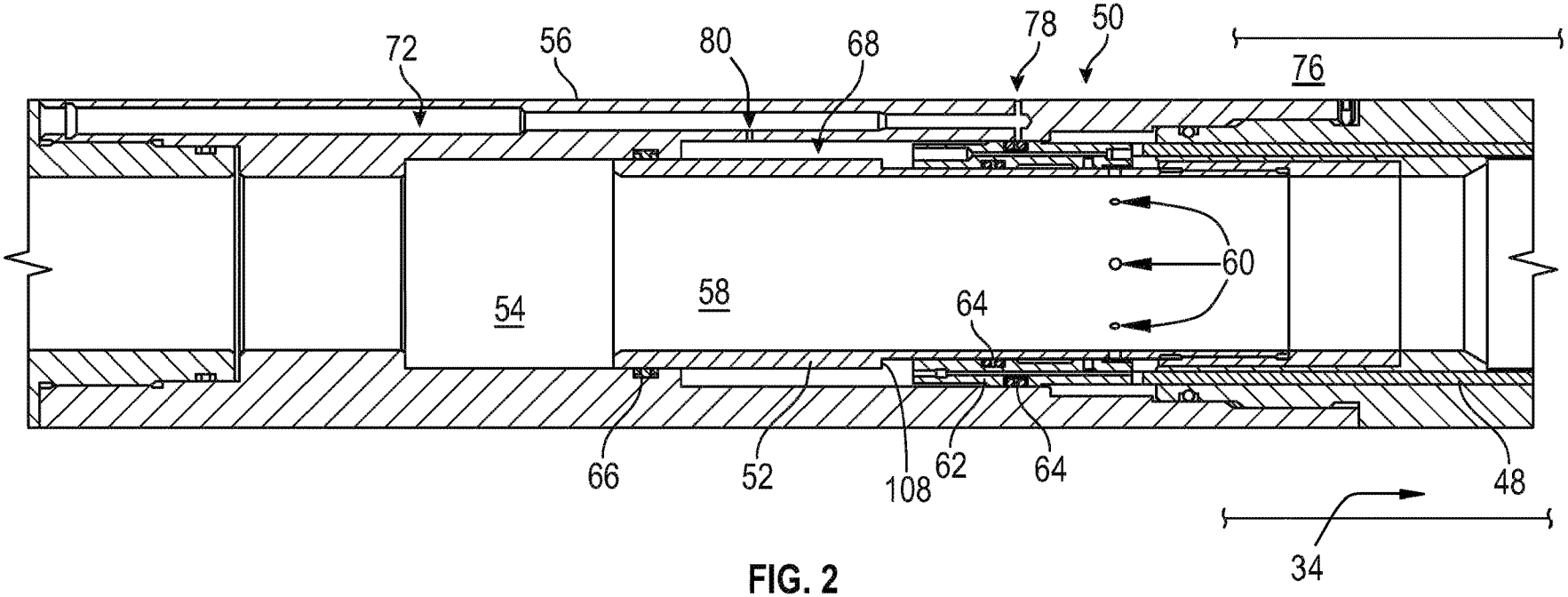
FIG. 2 is a cross-sectional illustration of an example of a trip saver section which may be used in actuating an isolation valve ball element or other downhole device according to an embodiment of the disclosure.

Referring generally to FIG. 2, an embodiment of the trip saver section 50 is illustrated as having an actuation piston 52 coupled with mechanical linkage 48. According to an embodiment, the mechanical linkage 48 may be moved in a linear direction to cause rotational shifting of ball valve element 40 between operational positions. However, the mechanical linkage 48 may be structured for causing rotational shifting, linear shifting, or other suitable shifting for actuating a corresponding device 36.

The actuation piston 52 is slidably mounted within an open interior 54 of a trip saver housing 56 and includes an internal through passage 58. A series of actuation piston ports 60 may extend laterally, e.g. radially, from internal through passage 58 to the exterior of actuation piston 52. An intermediate piston 62, e.g. a thermal compensating piston, may be positioned between actuation piston 52 and the surrounding housing 56. The intermediate piston 62 is sealed with respect to both the actuation piston 52 and the housing 56 via a plurality of seals 64.

At least one additional seal 66 may be located between actuation piston 52 and the surrounding housing 56. The at least one seal 66 is located so as to create an intermediate chamber 68 longitudinally between seals 66 and seals 64 and radially between actuation piston 52 and surrounding housing 56. The intermediate piston 62 effectively moves to balance pressure between the tubing pressure experienced via actuation piston ports 60 and the pressure within intermediate chamber 68. The intermediate piston 62 effectively provides this pressure balancing prior to, for example, actuation of actuatable device 36.

Figure 3:
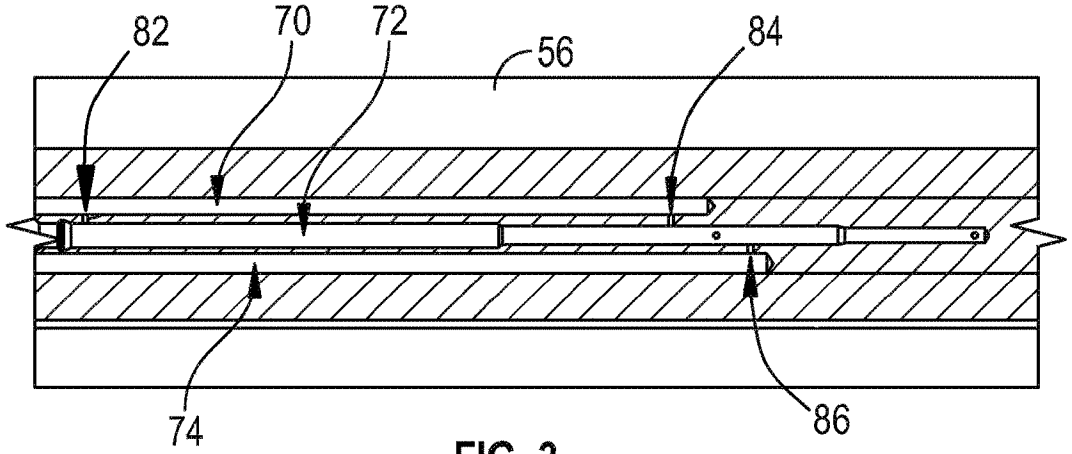
FIG. 3 is a cross-sectional view of a portion of a trip saver housing illustrated in FIG. 2, according to an embodiment of the disclosure.

With additional reference to FIG. 3, the housing 56 further comprises a plurality of chambers 70, 72, 74 disposed within the wall forming housing 56. The chambers 70, 72, 74 may be formed as gun drill ports or otherwise formed according to various drilling techniques, boring techniques, or other suitable formation techniques. In the example illustrated, the chambers 70, 72, 74 are in the form of tubing pressure chamber 70, center chamber 72, and atmospheric pressure chamber 74. The center chamber 72 may have a series of sections with different diameters to accommodate pressure signature responsive components (see FIGS. 4-6). As explained in greater detail below, the center chamber 72 may be in the form of a pilot piston chamber for receiving a pilot piston. It should be noted the tubing pressure chamber 70, center chamber 72, and atmospheric pressure chamber 74 may be arranged in different positions and relative locations within housing 56.

As illustrated in FIG. 2, the center/pilot piston chamber 72 is in fluid communication with a surrounding annulus 76 via an annulus port 78 and in fluid communication with intermediate chamber 68 via intermediate chamber port 80. As further illustrated in FIG. 3, the center chamber 72 is in fluid communication with tubing pressure chamber 70 via a first tubing pressure chamber port 82 and a second tubing pressure chamber port 84. The center chamber 72 also is in fluid communication with atmospheric pressure chamber 74 via an atmospheric pressure chamber port 86.

Figure 4:
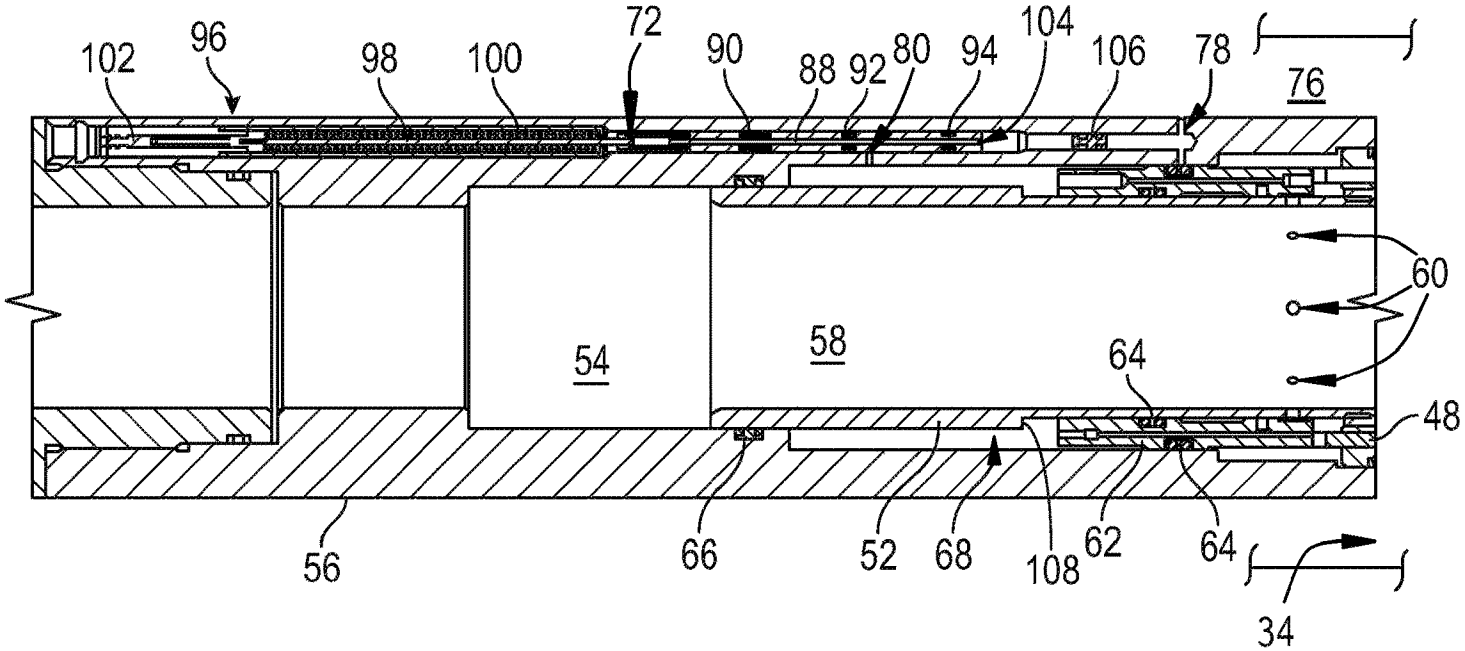
FIG. 4 is a cross-sectional illustration of the trip saver section with a pilot piston and cooperating indexer device positioned in a chamber of the trip saver housing, according to an embodiment of the disclosure.
Figure 5:
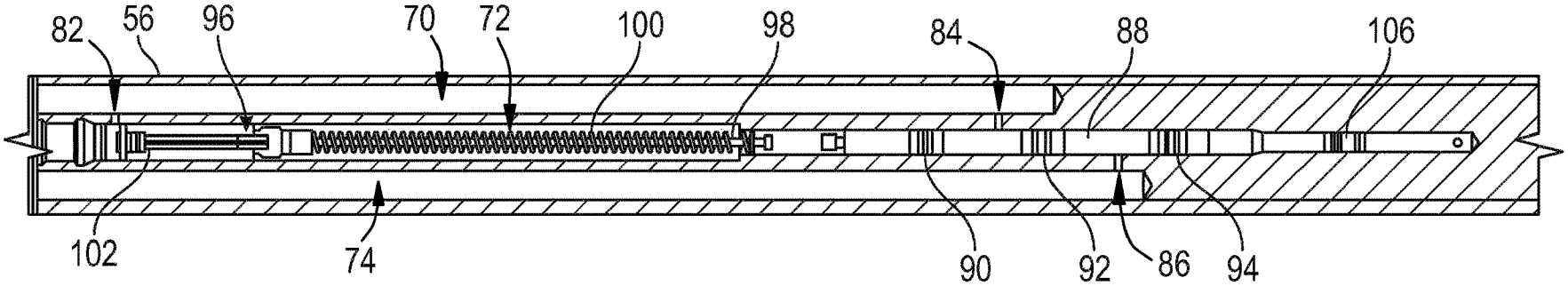
FIG. 5 is another cross-sectional illustration of the trip saver section with a pilot piston and cooperating indexer device positioned in a chamber of the trip saver housing, according to an embodiment of the disclosure.
Figure 6:
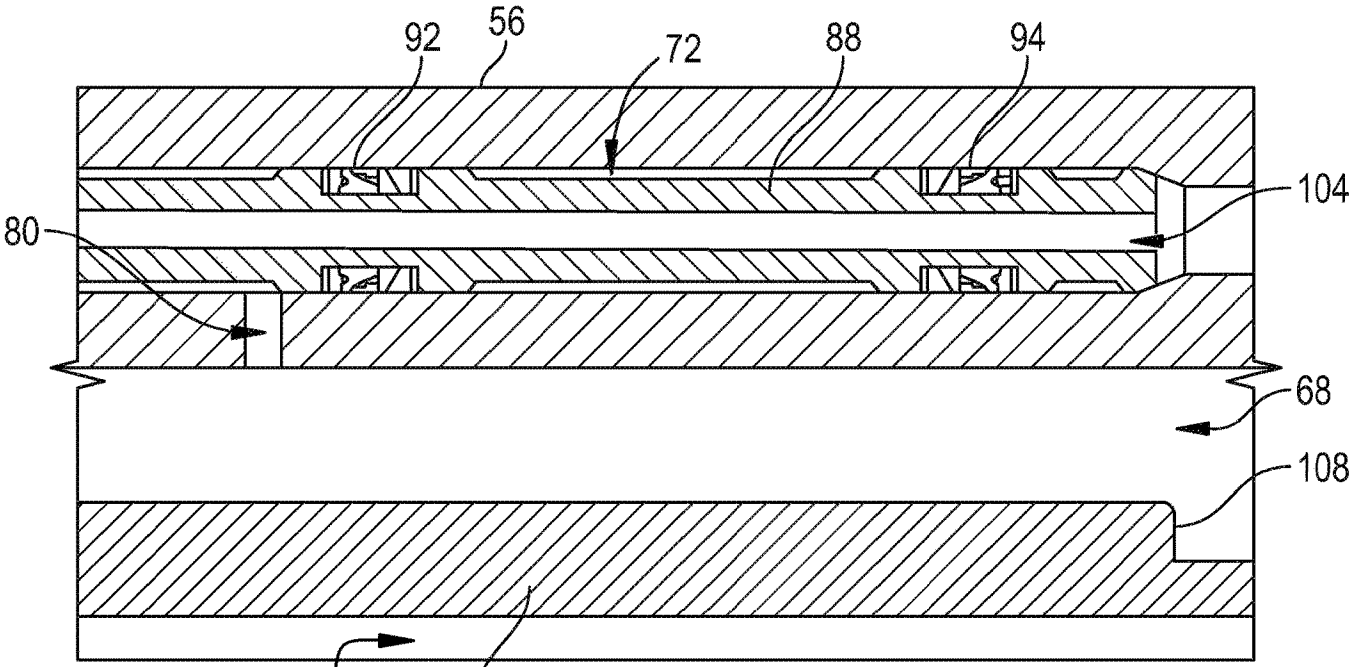
FIG. 6 is an enlarged cross-sectional illustration of a portion of the trip saver section which includes the pilot piston, according to an embodiment of the disclosure.

Referring also to FIGS. 4-6, an embodiment is illustrated in which a pilot piston 88 is slidably located within center chamber 72. The pilot piston 88 may be sealed with respect to the surrounding wall surface defining center chamber 72 via a plurality of seals 90, 92, 94. In the illustrated example, the pilot piston 88 is connected to an indexer 96 via, for example, a rod 98.

A spring 100 may be positioned around the rod 98 (or at another suitable location) to bias the pilot piston 88 and the indexer 96 in a given direction, e.g. in a leftward direction in the illustrated embodiment. The indexer 96 also is connected to an operator piston 102 which may be acted on by tubing pressure applied through tubing pressure chamber 70 and through the first tubing pressure chamber port 82.

When a tubing pressure is applied down through well string 32 and internal through passage 58, the tubing pressure is directed into tubing pressure chamber 70 and flows through first tubing pressure chamber port 82 so as to shift operator piston 102 against the resistance of spring 100. The shifting of operator piston 102 causes a consequent incremental shift of the indexer 96. When tubing pressure is released, the spring 100 biases operator piston 102 back to its original position to cycle the indexer 96.

In some embodiments, annulus pressure also may be used in cooperation with spring 100 to bias the operator piston 102 back to its original position. By way of example, the pilot piston 88 may have a longitudinal passage 104 which allows annulus pressure to be applied through the pilot piston 88, along spring 100, through indexer 96, and against operator piston 102 in a direction which assists spring 100. In the example illustrated, a thermal compensating piston 106 also is disposed in center chamber 72 between the pilot piston 88 and annulus port 78. The thermal compensating piston 106 may be used to separate annulus well fluid from clean hydraulic fluid located on the pilot piston side of thermal compensating piston 106.

Annulus pressure acts on thermal compensating piston 106 via annulus port 78 and transfers this pressure through pilot piston 88, along rod 98, through indexer 96, and against operator piston 102. It should be noted that intermediate piston 62 may similarly separate clean hydraulic fluid within intermediate chamber 68 from well fluid located within the internal through passage 58. This well fluid may come in contact with the opposite side of intermediate piston 62 (relative to the clean hydraulic fluid) via ports 60.

The indexer 96 may be appropriately constructed/programmed to respond to a predetermined pressure signature to release rod 98 so that spring 100 can transition rod 98 and pilot piston 88 to a subsequent position. For example, the pilot piston 88 may be shifted from an initial position illustrated in FIG. 6 to a subsequent flow position illustrated in FIGS. 4 and 5. According to an embodiment, the indexer 96 may be constructed to respond to a predetermined number of pressure cycles, e.g. pressure pulses. By way of further example, the indexer 96 may be constructed so as to release rod 98 and thus shift pilot piston 88 after ten pressure cycles (pulses) of increased pressure and released pressure (or other selected number of cycles). However, various other numbers and types of pressure cycles may be used as an applied pressure signal to establish the desired pressure signature.

In an operational example, the pressure signal, e.g. pressure pulses, may be applied down through the interior of well string 32 from the surface. The pressure signal travels into tubing pressure chamber 70 through a suitable port(s) or other fluid communication channel. The pressure signal continues to travel through tubing pressure chamber port 82 and into center chamber 72 on an opposite side of operator piston 102 relative to spring 100, thus causing shifting of piston 102 and indexer 96. The appropriate pressure signal is applied to operator piston 102 and indexer 96 until indexer 96 cycles to an actuation position allowing spring 100 to shift rod 98 and pilot piston 88.

In this manner, the pilot piston 88 is shifted from the position illustrated in FIG. 6 to the subsequent position illustrated in FIGS. 4 and 5. As pilot piston 88 is moved to the subsequent position, the pilot piston seal 92 moves past intermediate chamber port 80 (see FIG. 4). This allows the higher-pressure hydraulic fluid in intermediate chamber 68 to flow through intermediate chamber port 80 and into atmospheric pressure chamber 74, thus substantially lowering the pressure in intermediate chamber 68.

Because of the new position of pilot piston seals 92 and 94 across intermediate chamber port 80, a finite volume of a hydraulic fluid is able to pour into the atmospheric pressure chamber 74. As a result, the higher tubing pressure acting on intermediate piston 62 via the actuation piston ports 60 causes the intermediate piston 62 to shift against abutment 108 of actuation piston 52. The pressure differential between the tubing pressure in internal through passage 58 and the atmospheric chamber pressure now present within atmospheric pressure chamber 74 and intermediate chamber 68 causes the continued shifting of intermediate piston 62 and abutting actuation piston 52.

In the illustrated example, the actuation piston 52 is stroked in a leftward direction and pulls mechanical linkage 48 which, in turn, shifts the ball valve element 40 (or other actuated device). According to this example, the mechanical linkage 48 pulls the ball valve element 40 from a closed position to an open position. It should be noted the ball valve element 40 may be arranged to shift from an open position to a closed position or to shift to desired intermediate positions. Additionally, the ball valve element 40 may be replaced by other types of actuatable devices 36 which can be actuated between desired operational positions via use of the pilot piston 88 and pressure signature as described above.

Depending on the environment and application, the isolation valve 38 may be constructed to shift the ball valve element 40 or other device in various desired directions. However, the structure of trip saver section 50 enables the reverse ball design in which the ball valve element 40 is pulled open rather than being pushed to an open position. This reduces the stress on components involved in actuating the ball valve element 40 which, in turn, reduces the cost of materials and manufacturing. Additionally, components may be reduced in size, e.g. cross-section, due to the reduction in stress, thus potentially reducing the overall size of the isolation valve.

Furthermore, the trip saver section 50 may be constructed to provide an actuation piston 52 which is pressure balanced and prevented from moving until fluid is dumped into the atmospheric pressure chamber 74. As a result, the potential for accidentally opening the ball valve element 40 is reduced or eliminated. Embodiments described herein also remove the possibility of accidentally cycling backwards when cycling the indexer 96. In general, the construction of the isolation valve 38 provides a reduced number of seals, reduced number of potential leak paths, and a capability of eliminating control lines as compared to traditional isolation valves.

Although the operational example described herein describes a rotational ball valve element, the trip saver section 50 may be used to actuate various other types of devices 36. Depending on the type of device 36, the actuation motion may be a rotational motion, a linear motion, or another actuation motion. The size and layout of the chambers 70, 72, 74 also may be adjusted according to the types of operations intended, forces applied, and environmental considerations. The mechanical section 46 also may have a variety of configurations and sizes and may utilize various types of mechanical linkages 48 for converting the motion of the trip saver section 50 to the desired actuation motion for device 36, e.g. ball valve element 40.

Furthermore, the trip saver section 50 may be used to actuate the ball valve element 40 or other device between open and closed positions or between other desired operational positions. The indexer also may be constructed to respond to various types of pressure signatures, e.g. various numbers of pressure pulses. Additionally, the pressure signature may be applied as a pressure signal from a surface location or from another suitable location.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well string having an isolation valve disposed along the well string to selectively block or allow fluid flow along an interior of the well string, the isolation valve comprising:

a ball section having a ball valve element rotatable between a closed position and an open position;

a mechanical section coupled with the ball section to rotate the ball valve element; and a trip saver section which actuates the mechanical section, and thus the ball section, in response to an applied pressure signature, the trip saver section having:

a housing;

an actuation piston disposed within an internal passage of the housing, the actuation piston being movable along the internal passage in response to a pressure differential so as to actuate the mechanical section and thus the ball valve element;

an intermediate chamber formed partially by the actuation piston; and a plurality of chambers formed in a wall of the housing, the plurality of chambers including a tubing pressure chamber, an atmospheric pressure chamber, and a pilot piston chamber containing a pilot piston, the pilot piston being shiftable, in response to the applied pressure signature, from a first position in which the pilot piston blocks communication between the atmospheric pressure chamber and the intermediate chamber, to a second position which places the atmospheric pressure chamber in communication with the intermediate chamber so as to establish the pressure differential which shifts the actuation piston.

2. The system as recited in claim 1, wherein the pilot piston is connected to an indexer.

3. The system as recited in claim 2, wherein the indexer is connected to an operator piston on one side and to a spring on the other side to enable sequential shifting of the indexer in response to tubing pressure cycles.

4. The system as recited in claim 3, wherein the housing further comprises an annulus port positioned to allow annulus pressure to act on the indexer in a direction assisting the spring.

5. The system as recited in claim 3, wherein the indexer, the operator piston, and the spring are all contained in the pilot piston chamber.

6. The system as recited in claim 2, wherein the pilot piston comprises a plurality of seals which are positioned to interact with ports formed through the housing.

7. The system as recited in claim 6, wherein the plurality of seals is arranged such that at least one seal blocks fluid flow into the atmospheric chamber until the indexer shifts the pilot piston.

8. The system as recited in claim 1, wherein the chambers of the plurality of chambers are each formed as a gun drilled port.

9. The system as recited in claim 1, wherein the isolation valve is deployed downhole in a wellbore.

10. A system, comprising:

a trip saver section which actuates a device between operational positions in response to a pressure signature, the trip saver section comprising:

a housing having an internal through passage and a plurality of chambers formed in a wall of the housing;

an actuation piston movably disposed along the internal through passage, the actuation piston being sealed with respect to the surrounding housing to create an intermediate chamber, the plurality of chambers including an atmospheric pressure chamber in fluid communication with the intermediate chamber via a port;

a pilot piston shiftable in response to a predetermined pressure signal, the pilot piston being shiftable between a position preventing flow through the port and a position allowing flow from the intermediate chamber, through the port, and into the atmospheric pressure chamber to thus create a lower pressure in the intermediate chamber which initiates shifting of the actuation piston; and an intermediate piston positioned between the housing and the actuation piston to balance pressure between a tubing pressure and pressure within the intermediate chamber.

11. The system as recited in claim 10, wherein the plurality of chambers also comprises a pilot piston chamber for receiving the pilot piston and a tubing pressure chamber.

12. The system as recited in claim 11, wherein the pilot piston is connected with an indexer which receives a pressure signal applied from the surface.

13. The system as recited in claim 12, wherein the indexer is biased by a spring and further wherein the indexer and the spring are located in the pilot piston chamber.

14. The system as recited in claim 10, wherein the actuation piston is exposed to tubing pressure on a side opposite the intermediate chamber.

15. The system as recited in claim 10, further comprising a mechanical section coupled with the trip saver section, the mechanical section comprising an actuation linkage coupled with the actuation piston.

16. The system as recited in claim 15, further comprising an actuatable device connected to the actuation linkage.

17. The system as recited in claim 15, further comprising a ball section coupled with the mechanical section, the ball section having a ball valve element actuated between closed and open positions via movement of the actuation linkage in response to shifting of the actuation piston.

18. A method, comprising:

providing an isolation valve with an actuation piston slidably disposed along an internal through passage of a surrounding housing;

creating an intermediate chamber between the actuation piston and the surrounding housing such that pressure in the intermediate chamber acts on the actuation piston in a first direction;

exposing the actuation piston to tubing pressure in a second direction opposite the first direction;

preventing the actuation piston from actuating the isolation valve by blocking communication between the intermediate chamber and an atmospheric pressure chamber formed within a wall of the surrounding housing; and causing shifting of the actuation piston by opening communication between the intermediate chamber and the atmospheric pressure chamber, and transferring fluid from the intermediate chamber into the atmospheric pressure chamber.

19. The method as recited in claim 18, wherein transferring fluid from the intermediate chamber into the atmospheric pressure chamber is controlled by a pilot piston shiftable in response to a pressure signature to expose a port between the intermediate chamber and the atmospheric pressure chamber.

20. The method as recited in claim 19, further comprising triggering shifting of the pilot piston by applying a pressure signature to an indexer coupled to the pilot piston.

* * * * *